United States Patent [19]

Reneault et al.

[11] Patent Number: 4,551,958

[45] Date of Patent: Nov. 12, 1985

[54] EXTERIOR INSULATING ELEMENT AND CLADDING EMPLOYING SUCH ELEMENTS

[75] Inventors: Patrick Reneault, Garches; Francis Ovaert, Paris, both of France

[73] Assignee: SMAC Acieroid, Paris, France

[21] Appl. No.: 459,245

[22] Filed: Jan. 19, 1983

[30] Foreign Application Priority Data

Jan. 22, 1982 [FR] France ..... 82 00980

[51] Int. Cl.[4] ..... E04C 2/20

[52] U.S. Cl. ..... 52/309.4; 52/315; 52/533; 52/592

[58] Field of Search ..... 52/314, 315, 309.4, 52/538, 539, 553, 590, 542, 594, 541, 302, 420, 533, 478, 595, 592, 747, 748, 519

[56] References Cited

U.S. PATENT DOCUMENTS

| | | | |
|---|---|---|---|
| 691,239 | 1/1902 | Carnes | 52/553 |
| 1,063,674 | 6/1913 | Freund | 52/553 |
| 1,832,397 | 11/1931 | Hultquist | 52/592 |
| 1,909,625 | 5/1933 | Meier | 52/747 |
| 1,931,709 | 10/1933 | Schaffert | 52/314 |
| 2,139,620 | 12/1938 | Kirschbraun | 52/314 |
| 2,200,649 | 5/1940 | Wardle | 52/539 |
| 2,427,879 | 9/1947 | Robertson et al. | 52/541 |
| 2,612,246 | 9/1952 | Whitehouse et al. | 52/478 |
| 3,435,573 | 4/1969 | Krone . | |
| 3,740,909 | 6/1973 | Stinnes | 52/315 |
| 3,874,140 | 4/1975 | Seehusen | 52/315 |
| 3,969,851 | 7/1976 | Whitacre | 52/747 |
| 4,095,388 | 6/1978 | Breault | 52/590 |

FOREIGN PATENT DOCUMENTS

| | | | |
|---|---|---|---|
| 2831284 | 1/1980 | Fed. Rep. of Germany . | |
| 1218559 | 5/1960 | France . | |
| 260249 | 7/1949 | Switzerland | 52/592 |
| 2027089 | 2/1980 | United Kingdom | 52/309.4 |

OTHER PUBLICATIONS

German Patent Document No. H 21583 V/37 d, 1 Sht. Dwgs, 3 pages of Spec. Dec. 13, 1956.

*Primary Examiner*—James L. Ridgill, Jr.

*Attorney, Agent, or Firm*—Wenderoth, Lind & Ponack

[57] ABSTRACT

The insulating element is formed by a rectangular panel (1) composed of insulating material, such as extruded polystyrene foam whose edges (4, 6) include a longitudinal groove forming a rabbet (8) or a center groove (10). A pasty coating (2) containing mineral particles covers one of the sides of the panel (1) and a flat sealing element (14) is formed on two adjacent edges of the element and permits a rapid and simple assembly of the element with two other respectively juxtaposed and superimposed elements. This sealing element maintains the edges of the elements spaced apart on the outer side of the assembly but closes in a fluidtight manner the side facing the wall to be insulated.

18 Claims, 4 Drawing Figures

EXTERIOR INSULATING ELEMENT AND CLADDING EMPLOYING SUCH ELEMENTS

DESCRIPTION

The insulation of buildings from the exterior is currently employed to an increasing extent in the last few years.

It may be achieved, on the site, by means of an insulating panel which is directly adhered to the masonry or fixed mechanically, with a supporting framework covered with a protective facing. However, this method has the serious drawback of requiring a multitude of operations which depend on climatic conditions and take a long time to carry out.

It is consequently more and more frequent to employ a process known under the same of cladding which uses semi-finished elements comprising a metal facing adapted to be secured to the wall which maintains and protects a heat insulating panel which is spaced from this facing by ribs or a framework forming layers of ventilating air. In the elements of this type, the facing, which ensures both the mechanical stability the surface protection and the seal against rain water, is indeed substantially impermeable so that an important problem is posed by the condensation of water vapour thereon in cold periods and the discharge of this water. The layers of air reduce this condensation but increase the thickness of the element. Further, the appearance of the facing is often sensitive to impacts.

An object of the present invention is to overcome these drawbacks and to provide an insulating element which avoids the problem of condensation and yet is easy to place in position and is of a relatively low price.

The invention therefore provides an exterior insulating element which comprises a rectangular panel of a heat insulating material having good strength and conserving good thermal performances in a humid environment, one of the sides of the panel carrying a facing whereas the edges of the panel each include a longitudinal groove and have, in the vicinity of the side opposed to said facing, a length exceeding the length of the side provided with said facing, whereby each edge is capable of coming into a sealed contact with the edge of an adjacent element but the grooves always remain open between the elements on the side having said facing but are narrower than the depth of the grooves.

Preferably, the panel is made from an extruded polystyrene foam.

The element constructed in this way has a favourable permeability ratio since the facing may be a permeable coating whereas the heat insulating panel resists the passage of water vapour. The condensation effect is eliminated and the fabrication of the element is simplified.

According to one embodiment, a flexible, foam, sealing and spacing element having an adhesive on both sides is mounted on two adjacent edges of the element.

According to another embodiment, the insulating panel comprises on two adjacent sides a lateral extension in the vicinity of the side opposed to the said facing.

This form of the element permits an easy and immediate assembly of a number of elements in side-by-side relation and superimposed relation. However, the section and the position of the grooves of the edges prevent a true fitting together and define open joints on the side formed by the facing.

The invention also relates to a cladding achieved by means of elements of the type defined hereinbefore, disposed in a superimposition of rows of side-by-side elements whose edges are in fluidtight contact solely in the vicinity of the side opposed to said facing, said edges being spaced apart on the side provided with said facing, their grooves forming decompression chambers in communication with the exterior, and means for fixing the elements to a front wall.

This chadding is consequently perfectly fluidtight in the region of the front wall and yet is open on the opposite side and the grooves provide an interruption of capillarity which permits the discharge of water of condensation by preventing the penetration of the exterior humidity.

The following description of one embodiment, given merely by way of example and shown in the accompanying drawings, will bring out the advantages and features of the invention.

Figure 1:
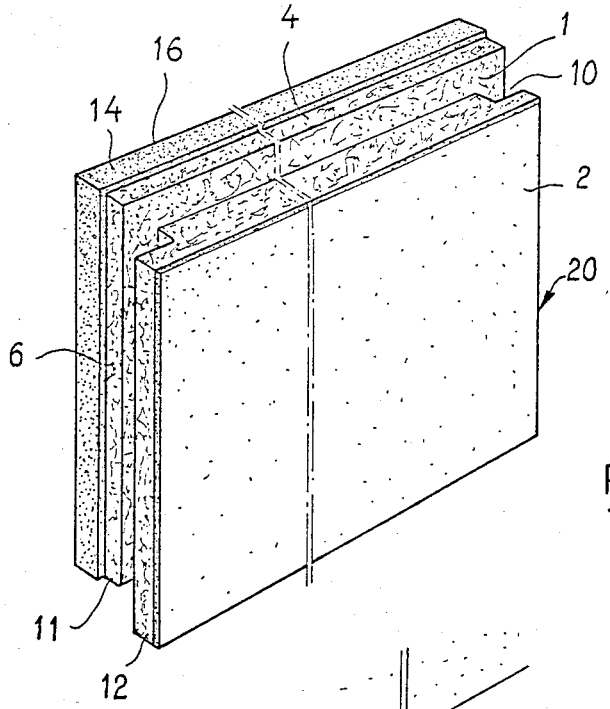
FIG. 1 is a perspective view of an element providing an insulation from the exterior.

The element 20 shown in FIG. 1 comprises a generally rectangular panel 1 made from an heat insulating material and having a low coefficient of conductivity and above all a good constancy of these thermal performances, even in a humid environment, and a good strength, in particular as concerns piercing and compression. Preferably, this panel 1 is made from an extruded polystyrene foam.

One of the sides of the panel 1 is covered with a pasty coating 2 containing resins, charges and mineral particles which have an excellent resistance to impact and a good performance as concerns running water. This coating is for example a thick facing a plastics or a mixture of mineral particles and charged acrylic or acrylovinylic resins which may be deposited in the factory by spraying, or applied with a spatule or a plasterer's hawk or by a like method.

Further, each of the edges 4 or 6 of the panel 1 includes a longitudinal groove 8, 10. This groove may be laterally open, and constitute a rabbet 8 or may be defined by two ribs 11 and 12 respectively. In the embodiment shown in the drawing, the panel comprises, in two opposed edges 4, two rabbets 8 and 9 facing in opposite directions and, in the other two edges 6, a centre groove 10.

A sealing element 14 is placed on the periphery of the panel 1 on two adjacent edges 4 and 6 of the panel in the vicinity of the planar side 16 opposed to the coating 2. The sealing element 14 is preferably formed by a flat band of flexible material such as an airtight and watertight foam material and is adhesive on both sides. This sealing element is adhered to the edge 4 or 6 and permits the assembly of the insulating element 20 thus constructed with a neighbouring element and a superimposed element.

Consequently, in order to form a cladding on a front wall 18, the element 20 shown in FIG. 1 is combined with other like elements in a succession of superimposed rows. Each of its two rabbets 8 and 9 is inserted in the rabbet of an upper element and a lower element, the sealing element 14 of the lower element 20 being adhered to the edge of the immediately upper element 21. The presence of the sealing element 14 however prevents the real fitting together of these rabbets and automatically forms therebetween a gap or an open joint 23 in the vicinity of the facing or coating 2. Indeed, as shown in FIG. 1, on the rear side of the element 20 opposed to the facing or coating 2, the rear portions of the horizontal edges 4 of the element 20 have a length A which exceeds the length B of the front portions of the edges 4 of the element 20 on the front side thereof corresponding to the facing or coating 2. Further, the rear portions of the vertical edges 6 of the element 20 have a length C on the side of the element 20 opposed to the coating or facing 2 which exceeds the length D of the front portions of the edges 6 on the front side of the element 20 corresponding to the facing or coating 2. Preferably, the rabbets 8 and 9 are moreover sufficiently deep to ensure that their vertical sides do not come into contact with each other but define a decompression chamber 22. The joint 23 which is therefore open on the front side of the element formed by the coating 2, puts this decompression chamber 22 in communication with the exterior atmosphere. On the other hand, the sealing element 14 closes any communication between this chamber and the opposite side of the elements 20, ie. the front wall 18. The rear sides 16 of the various elements are therefore united in a sealed manner as concerns both water and air from the exterior.

Figure 2:
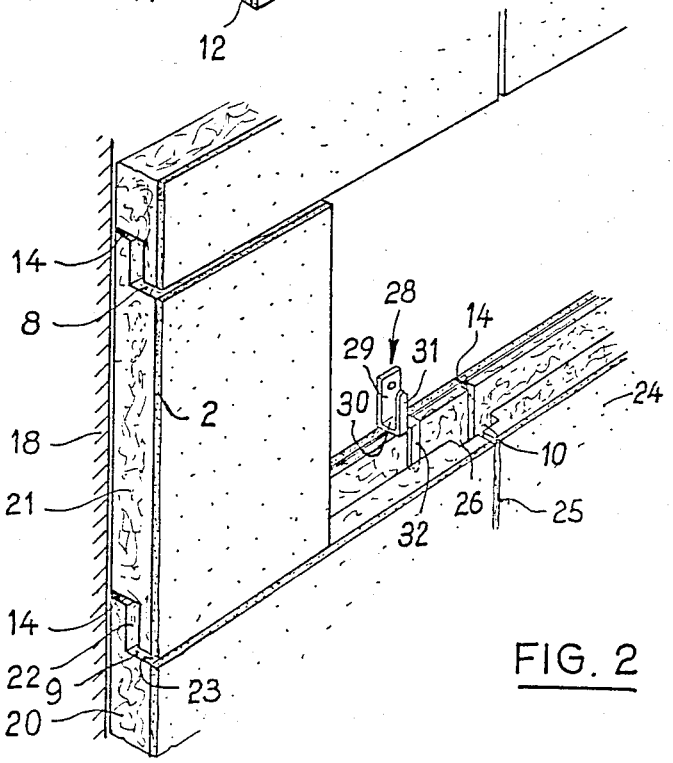
FIG. 2 is a perspective view of a portion of a cladding produced by means of elements such as that shown in FIG. 1.

Each element 20 is moreover juxtaposed with respect to other similar elements, for example the element 24 of FIG. 2. These elements are interconnected in a fluidtight manner by the sealing element 14 placed on the similar edge 6 of the element 24 to which the corresponding edge of the element 20 adheres. They are however also maintained spaced apart by this sealing element so that they do not come into contact with each other and a gap or an open joint 25 is formed on the outer side of the cladding between two successive facing coatings. The confronting grooves 10 define therebetween, in the same way as the rabbets, a decompression chamber 26 which is thus in communication with the atmosphere. On the other hand, on the opposite side adjacent to the front wall, the junction is fluidtight.

Owing to this arrangement, the running water is not liable to penetrate the interior of the cladding and the fluidtightness in the region of the front wall is ensured as concerns both air and water.

As the coating is very permeable, the permeability ratio of the element is favourable and the problem of condensation no longer exists in the cladding constructed in this way.

The group of insulating elements may be simply adhered to the front wall 18, but it may also be held mechanically by fasteners such as, for example, that shown at 28 in FIG. 2. This fastener comprises a tab 29 for fixing to the wall 18, which is folded at its lower part so as to form a surface 30 for bearing against the edge of the rabbet of the panel and two strips 31 and 32 extend in opposite and parallel directions, parallel to the wall-fixing tab 29, from this folded portion 30. One of the stips, namely the strip 32, is applied against the rabbet of a lower panel while the other strip 31 is embedded in the insulating panel of the immediately upper element when the latter is placed in position, In this way, each insulating panel is secured to the wall at several points and this mechanically maintains the whole of the element in position.

It will be understood that these fasteners, or like fasteners, may be combined if desired with a partial adhesion of the insulating panel to the front wall.

In any case, the successive elements are assembled very simply by putting the elements in contact with the sealing element 14 of the neighbouring element so that the spacing of the elements, and consequently the correct positioning thereof, is ensured automatically.

Figures 3, 4:
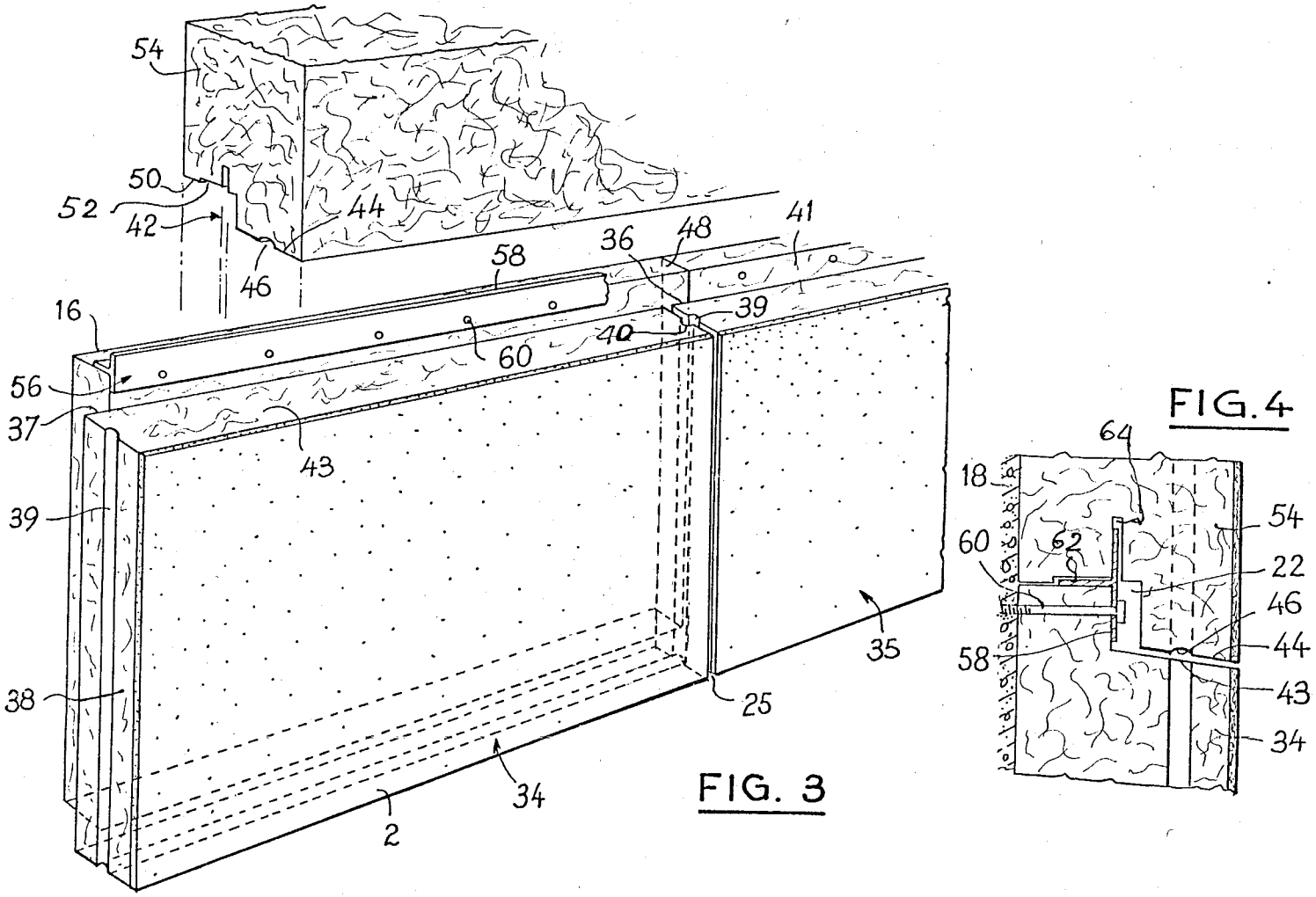
FIG. 3 is an exploded perspective view of a cladding according to a modification.
FIG. 4 is a vertical sectional view of the cladding shown in FIG. 3.

According to a modification shown in FIG. 3, the insulating element 34 comprises rabbets on its four edges, the opposed rabbets being open in opposite directions, respectively adjacent to the facing or coating 2 and adjacent the opposite or rear side 16. As in the case of element 20 shown in FIG. 1, this element 34 has horizontal edges which have a length A at the rear larger than the front length B and vertical edges which have a length C at the rear which is longer than the front length D corresponding to the facing or coating 2.

The centre grooves 10 of the vertical edges are thus replaced by rabbets 36, 37 which are capable of fitting together. Spacing and fluidtight contact means, such as the sealing element 14, is however provided on one of these vertical edges in the vicinity of the side 16. Consequently, as in the embodiment shown in FIGS. 1 and 2, when the element 34 is juxtaposed with another element 35, the rabbets 36 and 37 of the two adjacent elements fit together but the closures of the joint 25 is prevented, since the outer portions 38 of the edges adjacent to the facing or coating 2 cannot come into mutual contact. Preferably, decompression grooves 39, 40 are provided in each of these portions 38 of the vertical edges so as to render the open joint 25 self-draining.

The rabbets 41 and 42 of the upper and lower horizontal edges are similar to the rabbets 8 and 9 shown in FIGS. 1 and 2. However, preferably, these edges include an inclined surface 43, 44 in the vicinity of the side provided with the coating 2. The inclined surfaces 43 and 44 are parallel to each other and are inclined downwardly and outwardly so as to facilitate the discharge of water of infiltration or other water. Further, a longitudinal decompression groove 46 is provided in the lower inclined surface 44.

As in the preceding embodiment, a flexible sealing element, such as the sealing element 14, may be adhered to a horizontal edge and a vertical edge of the element 34. However, in this case, the spacing means are preferably in one piece with the insulating panel. As shown in FIGS. 3 and 4, on the vertical edge, the spacing means is formed by a simple lateral extension 48 of the inner portion, or the side adjacent to the front wall, of the insulating panel. This gives a depth to the rabbet 37 which exceeds the depth of the rabbet 36 and gives to the side 16 a width larger than the width of the opposite side. Likewise, the fluidtight and spacing means of the horizontal edge is an extension of the insulating panel in the vicinity of the side 16 which imparts to the latter a height exceeding that of the facing or coating. This extension in height forms on the lower edge, in the case of FIGS. 3 and 4, a rib 50 whose height corresponds to the desired opening for the open joint 23. The rib 50 has sufficient width to ensure a close contact between the element 54 to which it pertains and the element 34 placed thereunder but, preferably, it does not extend throughout the bottom of the rabbet 42 and defines a recces 52 which communicates with the decompression chamber 22.

These elements may form as easily as the preceding elements a cladding on a front wall, these elements being successively juxtaposed and superimposed. However, in order to secure the elements to each other and to the wall, elongated members 56 having a cross-sectional shape of a T on its side are employed by way of a modification.

Each member is fitted on the upper edges of the elements 34, 35 of a lower row, its vertical bar 58 bearing against the side of the rabbet 41 and projecting toward the elements 54 of the row thereabove. Fixing means 60 extend through this vertical bar 58 and the corresponding portion of the insulating panel and are fixed in the wall 18.

When the element 54 is put in contact with the elements 34, 35, the horizontal web 62 of the T-sectioned member is maintained in the recess 52 while the vertical bar 58 is disposed in a longitudinal slot 64 which extends from the bottom of this recess and permits a close contact between the superimposed elements.

The various elements are thus firmly assembled with each other and the wall and the shape and the position of the rabbets, grooves and recesses ensure the interruption of capillarity and the formation of decompression chambers connected to the outside environment by way of the open joints, which permits discharging water and provides and effective protection of the wall.

As the coating 2 has no mechanical function to perform, it can be easily constituted by a pasty compound of mineral particles which is deposited in the factory on the panels and adheres closely to the latter. This facilitates the production of the insulating element and permits the use of cheap coatings while ensuring a pleasant appearance of the outer surface of the cladding and impact resistance and a good performance as concerns running water. Such an insulating element can therefore be easily employed not only in the upper part but also in the lower part of a building.

Although the insulating mineral, and more particularly the extruded polystyrene, is only very slightly permeable to water vapour and water, in some cases it may be preferable to cover the edges 4 and/or 6 which are exposed to rain and ultraviolet rays with a protective coating or a thin metal section-member adhered to the element. Although the insulating material is resistant to humidity by its very nature, it is thus provided with an additional protection.

The cost of the insulating element constructed in this way is however relatively low. As moreover the assembly of the various elements is particularly simple and does not require specialized personnel, the elments may without inconvenience have relatively small dimensions. This permits the use of an insulating material having a high modulus of elasticity without increasing the risk of deformation under the effect of thermal shocks. Further, the decompression chambers associated with the joints open to the exterior enable the panels to expand without danger for the strength of the cladding.

There is thus provided a system for insulating from the exterior which imparts to a building a pleasant appearance while affording it effective protection and a long life.

Having now described our invention what we claim as new and desire to secure by Letters Patent is:

1. An assembly of adjacent similar elements in a substantially vertical plane, each element providing an exterior insulation for a wall, said element comprising a rectangular panel composed of a heat insulating foam material substantially impermeable to water and water vapour and having a good strength and good thermal performances in a humid environment, the element having two sides and four edges, a facing layer which resists penetration of running water but is not necessarily fully impermeable to humidity and is provided on a first of said sides, which first side is for constituting an outer side of said element when said element is combined with said wall, the four edges of the element each comprising a longitudinal groove and having, in the vicinity of a rear side of said element opposedto said first side, a length (A, C) exceeding to a given extent the length (B, D) of said first side, whereby each edge is in fluidtight contact with the edge of an adjacent similar element adjacent said rear side but said given extent being such that the edge remains spaced from the edge of said adjacent similar element adjacent said first side and forms gaps which are narrow relative to a depth of the gaps measured from said facing layer and the grooves are all open through said gaps between said similar elements only on said first side, and means defining decompression chambers provided in said edges defining said gaps between adjoining ones of said similar elements and spaced from said first side of each of said similar elements.

2. An assembly according to claim 1, wherein each panel is of an extruded polystyrene foam.

3. An assembly according to claim 1, wherein at least two opposed edges of each of said similar elements comprise a centre groove.

4. An assembly according to claim 1, comprising a flexible spacing and sealing member which is adhesive on opposite sides of the sealing member and is placed on each element and defines two adjacent edges of said edges of each of said similar elements.

5. An assembly according to claim 1, comprising decompression grooves in vertical edges of said edges in the vicinity of said first side of each of said similar elements.

6. An assembly according to claim 1, comprising decompression grooves in a lower edge of said edges in the vicinity of said first side of each of said similar elements.

7. An assembly according to claim 1, wherein said facing of each of said similar elements is a thick coating of plastics material containing resins, charges and mineral particles.

8. An assembly according to claim 1, wherein at least two opposed edges of said edges of each of said similar elements comprise longitudinal laterally open grooves forming rabbets facing in opposite directions.

9. An assembly according to claim 8, wherein the depth of the rabbets is sufficient to avoid the complete fitting together of said similar elements and to define said decompression chamber between said similar elements.

10. An assembly according to claim 1, comprising a lateral spacing extension on two adjacent edges in the vicinity of the side opposed to said first side of each of said similar elements.

11. An assembly according to claim 10, wherein the lateral extension defines a flat groove throughout the length of the adjacent edge of each of said similar elements.

12. A cladding providing an exterior insulation for a front wall and comprising a superimposition of substantially horizontal rows of similar insulating elements in adjoining relation to one another, each element comprising a rectangular panel composed of a heat insulating foam material substantially impermeable to water vapour and water and having a good strength and good thermal performances in a humid environment, each element having two sides and four edges, a facing layer which resists penetration of running water but is not necessarily fully impermeable to humidity and is provided on a first of said sides which constitutes an outer side of said element when said element is combined with said wall, the four edges of the element each comprising a longitudinal groove and having, in the vicinity of a rear side of said element opposed to said first side, a length (A, C) exceeding the length (B, D) of said first side, whereby each edge in the vicinity of said rear side of each element is in fluidtight contact with the edge of an adjacent similar element but the grooves are all open between the element on said first side, said elements being assembled in side-by-side relation, the edges of the elements being in fluidtight contact solely in the vicinity of said rear side opposed to said first side but are spaced from the edge of said adjacent similar element adjacent said first side and form gaps which are narrow relative a depth of said gaps measured from said facing layer, their grooves forming decompression chambers in communication through said gaps with only the exterior of the cladding on said first sides of said elements, and means for fixing the elements to said front wall.

13. A cladding according to claim 12, wherein horizontal gaps formed between edges of horizontal rows of said similar elements are downwardly inclined.

14. A cladding according to claim 12, wherein the insulating panels are adhered to the front wall.

15. A cladding according to claim 12, comprising mechanical fasteners for fixing the similar insulating elements to each other and to the wall, the fasteners being fitted on a rabbet of one element and embedded in a rabbet of the adjoining similar element.

16. A cladding according to claim 12, comprising members having a cross-sectional shape of a T placed on its side which fit the elements together and to the front wall, the members being fitted on the elements of one row and embedded in a longitudinal slot of the upper row of said similar elements.

17. An assembly of adjacent similar elements in a substantially vertical plane, each element providing an exterior insulation for a wall, said element comprising a rectangular panel of a plastic foam material substantially impermeable to water and water vapour, the element having two sides and four edges, a facing layer provided on a first of said two sides, which first side is for constituting an outer side of said element when said element is combined with said wall, said facing layer being resistant to penetration of running water but permeable to humidity, the edges of each similar element each comprising a longitudinal groove and having, in the vicinity of a rear side of said element opposed to said first side a length (A, C) exceeding to a given extent the length (B, D) of said first side, whereby each edge is in fluidtight contact with the edge of an adjacent similar element adjacent said rear side, said given extent being such that the edge remains spaced from the edge of said adjacent similar element adjacent said first side and forms a gap which is narrow relative to the depth of the gap measured from said facing layer, and the grooves always remain open through said gaps between the elements located only adjacent said first side, means defining decompression chambers provided in edges defining said gaps between adjoining ones of said similar elements and spaced from said first side of each of said similar elements, and elastically yieldable sealing members connected to each similar element and extending along the entire length (A,C) of at least two of said four edges adjacent said rear side of the element, said sealing members defining said at least two of said four edges.

18. A cladding providing an exterior insulation for a front wall and comprising a superimposition of substantially horizontal rows of similar insulating elements, each element comprising a rectangular panel composed of a heat insulating plastic foam material substantially impermeable to water and water vapour and having a good strength and good thermal performances in a humid environment, each element having two sides and four edges, a facing layer provided on a first of said sides which constitutes an outer side of said element when said element is combined with said wall, said facing layer being of a material resistant to penetration of running water but permeable to humidity, the edges of each element each comprising a longitudinal groove and having, in the vicinity of a rear side of said element opposed to said first side, a length (A, C) exceeding the length (B, D) of said first side, whereby each edge in the vicinity of said rear side of each element is in fluidtight contact with the edge of an adjacent similar element but the grooves are open between the elements on said first side, said elements being assembled in side-by-side relation, the edges of the elements being in fluidtight contact solely in the vicinity of said rear side opposed to said first side but being spaced from the edge of said adjacent similar element adjacent said first side and forming gaps which are narrow relative to a depth of said gaps measured from said facing layer, their grooves forming decompression chambers in communication with only the exterior of the cladding on said first side of said element through said gaps, means for fixing the elements to said front wall, and elastically yieldable sealing members connected to each similar element and defining at least two of said four edges of said element which have said length A and C and are located adjacent said rear side of the element, said lengths A and C being overall lengths of the element including said members.

* * * * *